US008820737B2

(12) United States Patent
Dobrindt

(10) Patent No.: US 8,820,737 B2
(45) Date of Patent: Sep. 2, 2014

(54) SHEET-TRANSPORT DEVICE, SHEET-TURNING UNIT AND METHOD FOR TURNING SHEETS

(75) Inventor: Dirk Dobrindt, Klausdorf (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/812,004

(22) PCT Filed: Jul. 11, 2011

(86) PCT No.: PCT/EP2011/061747

§ 371 (c)(1),
(2), (4) Date: Apr. 19, 2013

(87) PCT Pub. No.: WO2012/013479

PCT Pub. Date: Feb. 2, 2012

(65) Prior Publication Data

US 2013/0214479 A1 Aug. 22, 2013

(30) Foreign Application Priority Data

Jul. 28, 2010 (DE) ..... 10 2010 032 524
Jul. 28, 2010 (DE) ..... 10 2010 032 525

(51) Int. Cl.
*B65H 5/00* (2006.01)
*B65H 29/00* (2006.01)
*B65H 39/10* (2006.01)

(52) U.S. Cl.
USPC ..... 271/225; 271/186; 271/301

(58) Field of Classification Search
USPC ..... 271/301, 186, 65, 184, 185, 225
See application file for complete search history.

(56) References Cited

U.S. PATENT DOCUMENTS 4,836,119 A 6/1989 Siraco et al.
4,892,300 A 1/1990 Svyatsky
(Continued)

FOREIGN PATENT DOCUMENTS

EP 0418085 A2 3/1991
EP 0418086 A2 3/1991
EP 1246449 A2 10/2002

*Primary Examiner* — Patrick Cicchino

(57) ABSTRACT

Presented herein is a sheet turning unit (1) comprising a first sheet conveyor device (2*a*) for transporting a sheet at least along a first transport path (B1) in a first plane (E1), and comprising a second sheet conveyor device (2*b*) for transporting the sheet along a second transport path (B2), said second transport path extending at an angle of 90° with respect to the first transport path (B1) and, in sum, describing a curve of 180°, whereby the starting point of said curve is located in the first plane (E1) and the end point of said curve is located in a second plane (E2) that is different from the first plane, and comprising a third sheet conveyor device (2*c*) for transporting the sheet along at least a third transport path (B3). As a result of this, the leading edge of the sheet remains in front even after the turning operation, and a precisely functioning and reliable sheet turning unit is being provided. Furthermore, advantageous embodiments of the first and third sheet conveyor devices are described, said devices enabling the transport of a sheet in two directions. The advantageous embodiments of the first and third sheet conveyor devices are compact and simple in design and can be controlled easily. The advantageous embodiments of the first and third sheet conveyor devices comprise a sheet transport body that, by means of a rotating mechanism arranged in the sheet transport body, can be rotated about a first rotational axis and a second rotational axis, said axes extending through one point of intersection and being perpendicular to one another.

14 Claims, 8 Drawing Sheets

(56) References Cited

U.S. PATENT DOCUMENTS

| | | | | |
|---|---|---|---|---|
| 4,903,043 | A * | 2/1990 | Tajima | 346/134 |
| 5,042,791 | A * | 8/1991 | Stemmle | 271/186 |
| 5,052,678 | A * | 10/1991 | Looney | 271/186 |
| 5,666,629 | A | 9/1997 | Kazoh | |
| 6,059,284 | A * | 5/2000 | Wolf et al. | 271/227 |
| 6,554,276 | B2 * | 4/2003 | Jackson et al. | 271/301 |
| RE38,867 | E * | 11/2005 | Kusters | 271/225 |
| 7,766,322 | B2 * | 8/2010 | Nakamura et al. | 271/184 |
| 8,167,302 | B2 * | 5/2012 | Kawaguchi et al. | 271/186 |
| 8,437,684 | B2 * | 5/2013 | Mizuno et al. | 399/401 |
| 8,480,079 | B2 * | 7/2013 | Sugano et al. | 271/225 |
| 2002/0096822 | A1 * | 7/2002 | Glemser et al. | 271/186 |
| 2002/0140165 | A1 * | 10/2002 | Jackson et al. | 271/291 |
| 2007/0235925 | A1 * | 10/2007 | Johnston et al. | 271/301 |

* cited by examiner

SHEET-TRANSPORT DEVICE, SHEET-TURNING UNIT AND METHOD FOR TURNING SHEETS

TECHNICAL FIELD OF THE INVENTION

The present invention relates to a sheet transporting and turning unit for transporting and/or turning sheets in printing machines of other processing machines, as well as to a method for turning sheets. Furthermore, the present invention relates to sheet conveyor devices for transporting sheets in printing machines or the processing machines, and, in particular, to sheet conveyor devices that are suitable for transporting a sheet in two directions.

BACKGROUND ART

In the course of the processing, in particular the printing, of sheets it is frequently necessary to turn the sheet so that it be processed on both sides. For example, in known printing machines, a sheet turning device is provided, the device turning a sheet with the use of turning pockets. In such a sheet turning device comprising turning pockets, a sheet is first supplied in one direction by means of transport rollers and then fed into a sheet guide that is configured as a turning pocket. The leading edge of the sheet moves into the turning pocket, then the entire sheet is received by the turning pocket and subsequently moved out of the turning pocket with the formerly trailing edge now being the new leading edge. However, this widely used solution has the disadvantage that the turned sheet loses the allocation of the leading edge. The reason being that, in the turning pocket, the edge being located at the rear before the first turning operation now has become the leading element after the sheet has moved out of the turning pocket. This can result in inaccuracies in the printed image and in view of registration.

Furthermore, it is known to use an arrangement of several transport belts that are twisted relative to each other for turning sheets. In such a turning device, the transport directions are twisted together by 180° , and the sheets are turned by such a sheet turning unit for duplex printing. Such a sheet turning unit comprises four communicating deflecting rollers about which one transport belt, respectively, is being moved. The four deflecting rollers are arranged opposite each other on both sides of a transport path. The transport belts are guided around the deflecting rollers in such a manner that one transport belt is moved around a deflecting roller on the one side of the transport path, and the other transport roller is placed around a deflecting roller on the other side of the transport path. Then the transport rollers extend in a twisted manner over a swivel region in the center between the four transport rollers in such a manner that the transport belts are placed around the respective deflecting roller on the other side of the transport path. Due to this twisting or crossing of the transport belts, a sheet held between the transport belts is turned by 180° . One disadvantage of such sheet turning units is that, depending on the properties of the sheet, relative motions between the transport belt and the sheet may occur. Consequently, positioning inaccuracies may occur after the turning operation.

In order to provide offset functionality it is known in printing machines to transport a sheet in two directions, i.e., first in longitudinal direction and then in transverse direction of the sheet, with the use of two separately driven transport rollers in the sheet path. Thus the sheet is turned twice in transverse direction on an S-shaped curved path in order to ultimately be again aligned parallel to the original path. In doing so, the sheet can be transported further with a transverse offset. Due to the double curved movement of the sheets the transport rollers must have a very slim design because relative motions occur between the sheet and the driving transport rollers. With a wider configuration of the transport rollers the sheet could be damaged because the speed of the sheet is not uniform across the width of the transport roller. The reason being that the sheet moves more slowly at a point of contact with the transport roller closer to the inside of the curve than at a point of contact closer to the outside of the curve. Inasmuch as the transport rollers are very slim, counter rollers located opposite the transport wheels are subject to greater wear, and grooves may form at the pressure point of the transport rollers. In addition, an expensive software program and measuring system are required to enable subsequent corrections of the sheet alignment.

Furthermore, it is known to use diagonally moving transport belts with oppositely supported balls as the pressure points. As a result of the fact that diagonally extending transport belts are used the sheets must be aligned along a lateral abutment, however. This is a problem with thin sheets, in particular, because they tend to buckle. Also, the edges of the sheets may be damaged.

SUMMARY OF THE INVENTION

In view of the above-presented prior art, it is an object of the invention to provide a sheet turning unit and a method for turning sheets, the unit and the method overcoming at least one of the aforementioned disadvantages of the prior art.

It is also an object of the present invention to provide a sheet conveyor device for conveying the sheet in two directions, the device being compact, simple in design and easy to control.

In particular, an object of the invention is achieved by a sheet turning unit comprising: a first sheet conveyor device for transporting a sheet at least along a first transport path in a first plane; a second sheet conveyor device for transporting the sheet along a second transport path, the second transport path extending at an angle of 90° with respect to the first transport path and, in sum, describing a curve of 180° , whereby the starting point of the curve is located in the first plane and the end point of said curve is located in a second plane that is different from the first plane; and a third sheet conveyor device for transporting the sheet along at least a third transport path. As a result of this, the leading edge of the sheet remains in front event after the turning operation, and a precisely functioning and reliable sheet turning unit is being provided.

In varying embodiments of the sheet turning unit, the third transport path extends either in the same direction as the first transport path, or in the same direction as the second transport path, or in the direction opposite the first transport path.

Preferably, the second sheet conveyor device comprises at least one transport roller that is supported so as to be rotatable about a rotational axis, the rotational axis extending parallel to the first transport path. Due to this, a simple design of the second sheet conveyor device is achieved. In this arrangement, the second transport path advantageously extends over 180° along the external circumference of the transport roller.

In one embodiment, the first and/or the third sheet conveyor devices comprise at least one sheet transport body that can be rotated about a first and a second rotational axis by means of a rotating mechanism located in the sheet transport body, the rotational axes extending through one point of intersection and being perpendicular to one another. Due to this embodiment, a compact design of the sheet conveyor device is possible and the control of the device is simple.

In accordance with one embodiment of the sheet conveyor device the sheet transport body can be rotated independently about the first and second rotational axes. Consequently, various modes of transporting the sheet can be implemented with only one sheet conveyor device.

In one exemplary embodiment of the sheet conveyor device, the sheet transport body can be driven by a driving mechanism for rotation about at least one of the rotational axes, and by a driving motor connected with the driving mechanism. Consequently, the sheet conveyor device can perform active and/or passive actions while sheets are being transported.

In one embodiment, the driving mechanism comprises a freewheel device that is arranged between the sheet transport body and the driving motor. Consequently, the control of the sheet conveyor device can be simplified, on the one hand, and high rotational speeds of the sheet transport body can be achieved in freewheel direction, on the other hand, without the risk of damaging the driving motor.

In order to provide a simple and easily manufactured design of the sheet transport device the sheet transport body is spherical, with the annular transport paths extending over the circumference of the spherical sheet transport body.

In one embodiment of the sheet turning unit, the first and/or third sheet conveyor devices, respectively, comprise several sheet transport bodies that are driven by a common driving motor. Thus costs and design space can be saved.

Advantageously, pressure spheres are arranged in a resilient manner opposite the sheet transport bodies so that the pressure spheres and the sheet transport bodies are able to hold one sheet. Thus a compact design of the pressure spheres is achieved, offering moving options in two directions.

In one embodiment of the sheet turning unit, the first, second and/or third sheet conveyor device comprise at least one transport roller and one transport roller lifting mechanism that is suitable to lift the transport roller off the transport path in a controlled manner. Consequently, a sheet can be moved in different directions without being damaged.

In another embodiment of the sheet turning unit, the first, second and/or third sheet conveyor device comprises at least one transport roller having a segmented recess or a flat region on its circumference. Thus, an additional possibility is provided for transporting the sheet in different directions without damaging the sheet.

In one embodiment, the first and third sheet conveyor devices, respectively, comprise at least one sheet transport body. In this case, the number of sheet transport bodies of the third sheet conveyor device is preferably greater that the number of sheet transport bodies of the first sheet conveyor device. Consequently, sheets having different lengths can be transported in a reliable manner.

Furthermore, an object of the invention is achieved by a method for turning sheets in a sheet processing machine, the method comprising the following steps: transporting a sheet along a first transport path in a first plane; transporting the sheet along a second transport path, the second transport path extending at an angle of 90° with respect to the first transport path, and, in sum, describing a curve of 180° , whereby the starting point of the curve is located in the first plane and the end point of the curve is located in a second plane that is different from the first plane; and transporting the sheet along a third transport path. As a result of this, the leading edge of the sheet remains in front event after the turning operation, and a precisely functioning and reliable sheet turning unit is being provided.

In the method, the second transport path preferably describes a semi-circle so that the sheet is being turned.

In different embodiments of the method, the third transport path extends either in the same direction as the first transport path or in the same direction as the second transport path, or in the direction opposite the first transport path.

Advantageously, transporting of the sheet along the second transport path in the method uses a greater speed than transporting of the sheet along the first transport path. In this manner, it is also possible to divide successively following sheets or achieve a change of the distance between successively following sheets.

In particular, an object of the invention is achieved by a sheet conveyor device comprising a sheet transport body that, by means of a rotating mechanism arranged in the sheet transport body, can be rotated about a first rotational axis and a second rotational axis. Both rotational axes extend though one point of intersection and are perpendicular to one another. This embodiment enables a compact design of the sheet conveyor device and its control is simple.

In accordance with one embodiment of the sheet conveyor device, the sheet transport body can be rotated independently about the first and the second rotational axes. As a result of this, different modes of transport of the sheet can be implemented with only one sheet conveyor device.

Preferably, over the outside of the sheet transport body extend a first ring-shaped transport path for transporting a sheet in a first transport direction, and a second ring-shaped transport path for transporting a sheet in a second transport direction. As a result of this, damages to the sheet and a groove formation at the pressure point of a counter-roller are prevented.

In one exemplary embodiment of the sheet conveyor device, the sheet transport body can be driven by a driving mechanism for rotation about at least one of the rotational axes, and by a driving motor connected with the driving mechanism. Consequently, the sheet conveyor device can perform active and/or passive actions while sheets are being transported.

In one embodiment, the driving mechanism comprises a freewheel device that is arranged between the sheet transport body and the driving motor. Consequently, the control of the sheet conveyor device can be simplified, on the one hand, and high rotational speeds of the of the sheet transport body can be achieved in freewheel direction, on the other hand, without the risk of damaging the driving motor.

The driving mechanism may comprise a bevel gear drive and/or belt drive arranged between the sheet transport body and the driving motor in order to achieve low-maintenance design.

In accordance with one exemplary embodiment, the sheet conveyor device comprises two driving mechanisms, each comprising a driveshaft. At least one driveshaft is a hollow shaft with an interior space in which the other driveshaft is accommodated in a rotatable manner. In this way, a compact design can be implemented.

In order to provide a simple and easily manufactured design of the sheet conveyor device the sheet transport body is spherical, with the annular transport paths extending over the circumference of the spherical sheet transport body.

Preferably, the spherical sheet transport body comprises two oppositely arranged semi-spherical half shells having an edge and a vertex in the middle of the curvature of the half shell. The one ring-shaped transport path extends along the edge of the two half shells, and the other ring-shaped transport path extends over the circumference of the spherical sheet transport body at an angle of 90° relative to the first ring-shaped transport path extending over the vertex.

Preferably, the sheet conveyor device comprises at least one sensor for sensing an alignment of the sheet transport body. Consequently, the rotational position of the sheet transport body can be determined, and a sheet can be transported without being forcefully imparted with a rotary motion.

With a sheet transport arrangement that comprises at least two of the above-described sheet conveyor devices, the devices having transport paths arranged on the same level, it is possible to implement a plurality of transport options for one sheet.

In one embodiment of the sheet transport arrangement, the sheet conveyor devices can be driven at different speeds, so that it is possible to—optionally—achieve a straight or curved transport path of a sheet. In one embodiment, the different speeds of the sheet conveyor devices display a fixed gear ratio in order to achieve a curved transport path with a constant radius.

Considering the sheet transport arrangement, preferably at least two of the sheet conveyor devices can be driven by a common driving element. This saves components. In accordance with one embodiment, the common driving element may define a fixed gear ratio when the sheet conveyor devices are being driven. In this manner, the control of the sheet transport arrangement is simplified in an advantageous manner.

BRIEF DESCRIPTION OF THE DRAWINGS

The invention, as well as additional details and advantages of the invention are explained hereinafter with reference to preferred exemplary embodiments and with reference to the figures. They show in FIG. 1 a schematic front view of a sheet turning unit as in the present invention, as can be viewed from the direction of a transport path;

FIG. 6 schematic illustrations of potential sheet transport directions for a sheet in the sheet turning unit in accordance with FIG. 1, wherein FIG. 6A illustrates the supply of a sheet to the sheet turning unit, wherein FIG. 6B illustrates the turning operation of a sheet in the sheet turning unit, and wherein

DETAILED DESCRIPTION OF THE INVENTION

It should be noted that expressions such as above, below, front, back, right and left, as well as similar information, relate to the alignments or arrangements shown in the figures and are only disposed to describe the exemplary embodiments. However, these expressions must not be understood in restricting terms.

Figure 1:
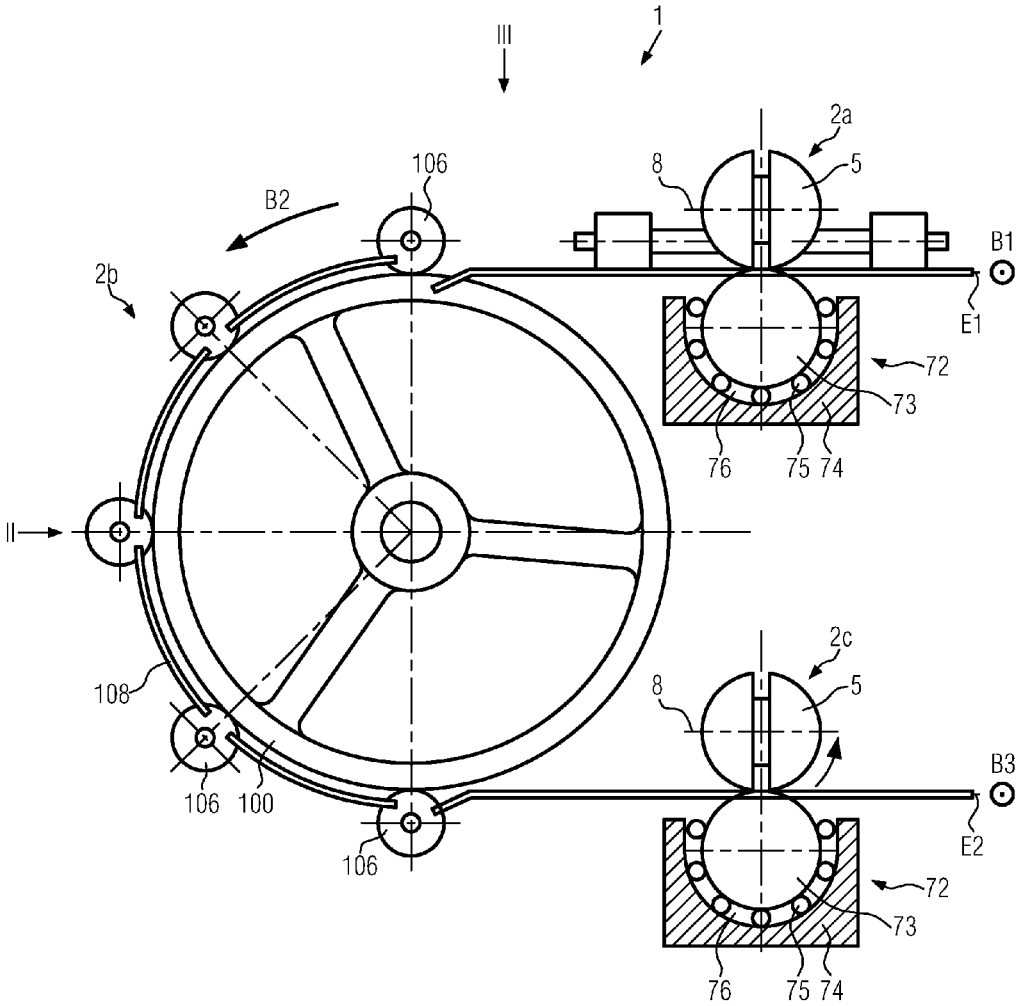
Figure 2:
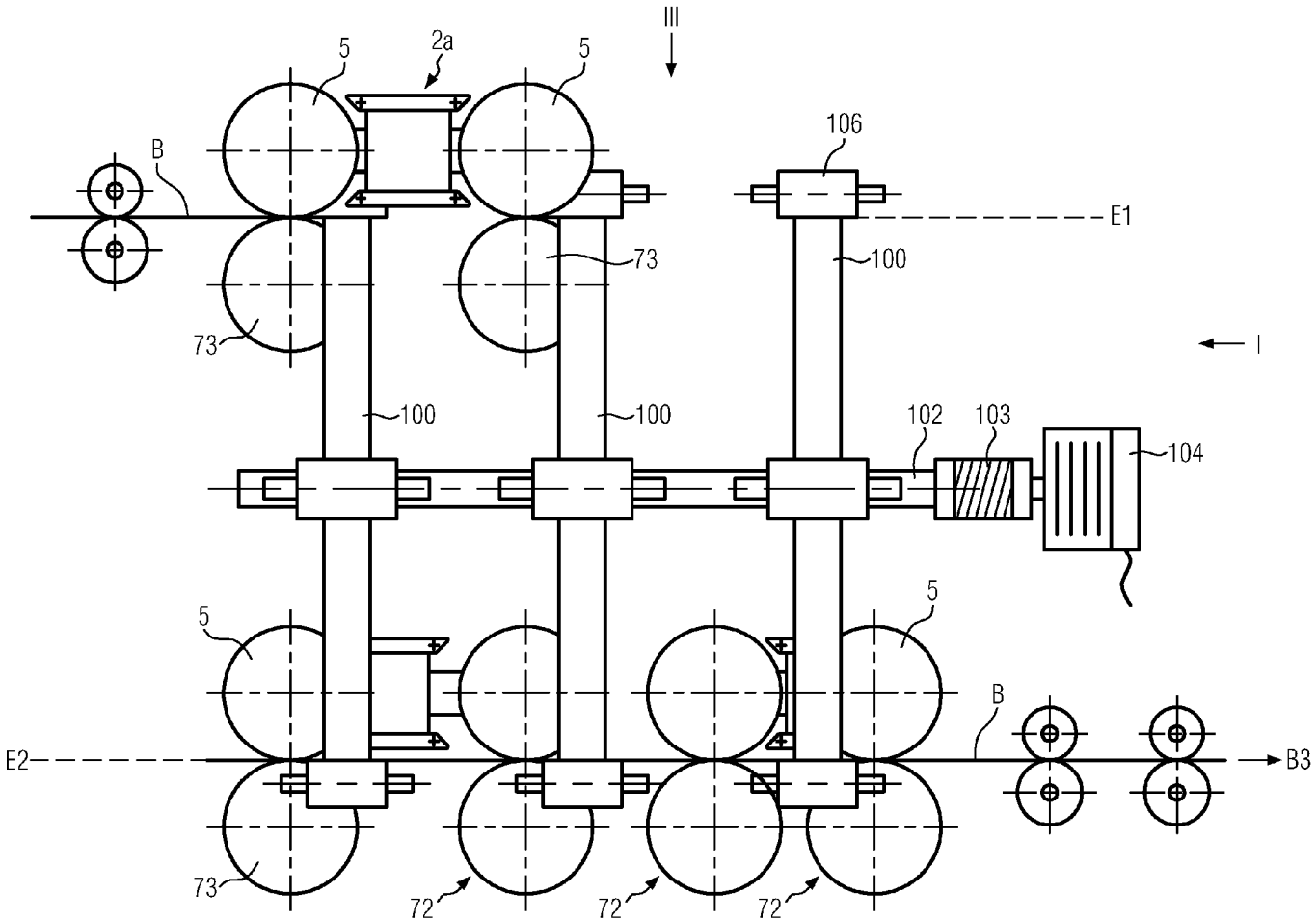
FIG. 2 a schematic side view of the sheet turning unit shown in FIG. 1, viewed from the direction of arrow II in FIG. 1.
Figure 3:
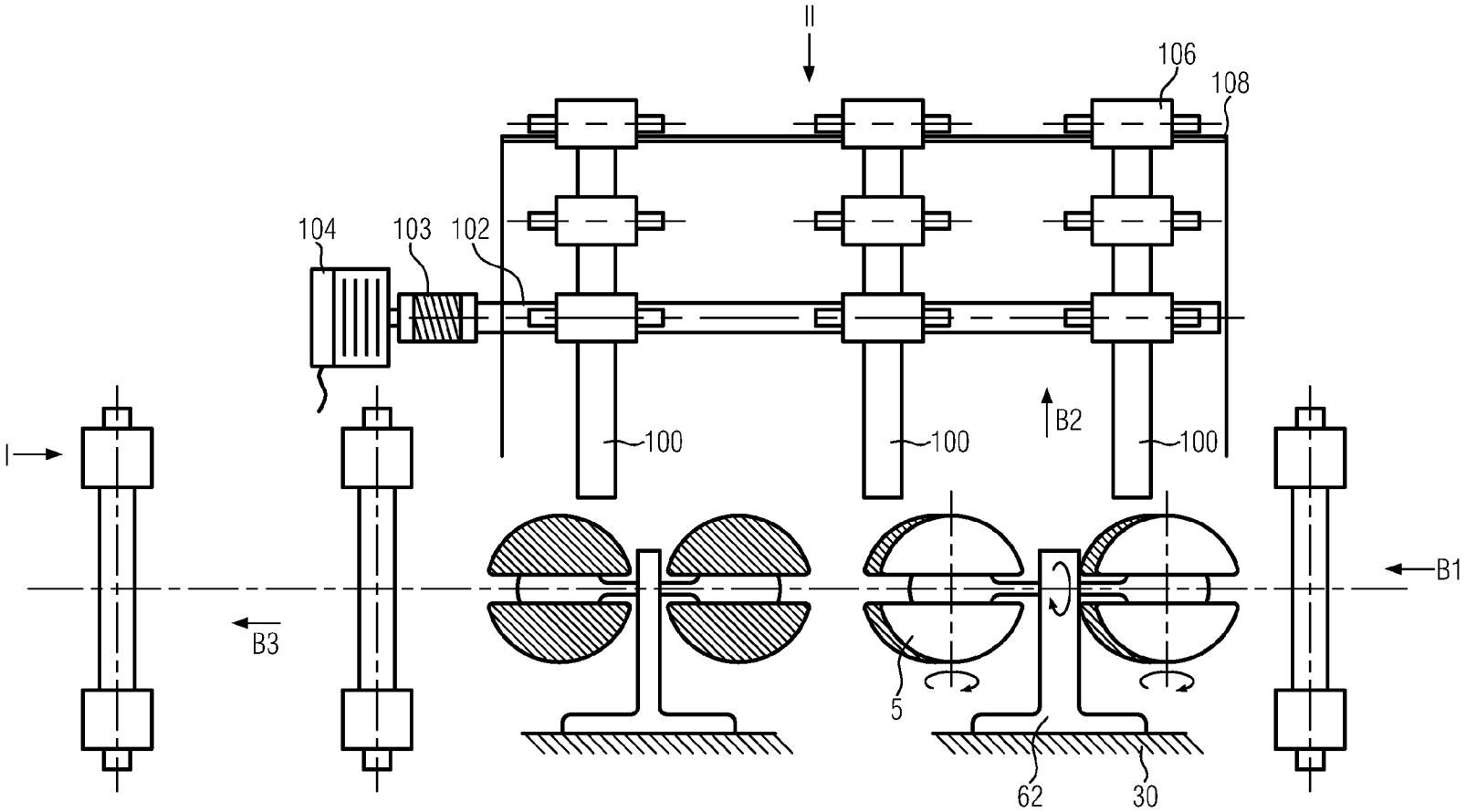
FIG. 3 a schematic plan view of the sheet turning unit shown in FIGS. 1 and 2, viewed from the direction of arrow III in FIGS. 1 and 2.

FIGS. 1, 2 and 3 show various views of a sheet turning unit 1. FIG. 1 is a schematic view of the sheet turning unit 1, viewed from the direction of a first transport path (arrow B1). The transport path B1 extends perpendicularly with respect to the plane of projection of FIG. 1, wherein a sheet B (see FIGS. 2 and 6) is being supplied from a direction below the plane of projection and delivered in a direction toward the upper side of the plane of projection of FIG. 1. FIG. 2 shows a schematic view of the sheet turning unit 1 from the side, i.e., at an angle of 90° relative to the transport path B1. In FIG. 2, the transport path B1 extends from left to right. FIG. 3 shows the sheet turning unit 1 from the top, i.e., in a plan view of the transport path B1. In FIG. 3, the transport path B1 extends from left to right. Furthermore, FIGS. 1, 2 and 3 show viewing angles of the respectively other figures, wherein the arrow I corresponds to the view of FIG. 1, wherein the arrow II corresponds to the view of FIG. 2, and wherein the arrow III corresponds to FIG. 3.

The sheet turning unit 1 comprises a first sheet conveyor device 2*a*, a second sheet conveyor device 2*b* and a third sheet conveyor device 2*c*. The first sheet conveyor device 2*a* is intended for transporting a sheet B (not shown in FIGS. 1 through 3) along a first transport path B1 in a first plane E1. The second sheet conveyor device 2*b* is intended for transporting the sheet B along a second transport path B2 at an angle of 90° with respect to the first transport path B1 and toward a second plane E2. The second transport path B2 describes, in sum, a curve of 180°, whereby the starting point of the curve is located in the first plane E1 and the end point of the curve is located in a second plane that is different from the first plane E2. The third sheet conveyor device 2*c* is intended for transporting the sheet B along a third transport path B3 in the second plane E2, for example, for further processing in a printing machine 4 that is shown in greater detail in FIGS. 7 and 8.

Basically, the first sheet conveyor device 2*a* and the third sheet conveyor device 2*c* may have a conventional, known design of a sheet conveyor device. For example, the sheet conveyor devices 2*a* and 2*c* may comprise driven transport rollers or transport belts with oppositely arranged pressure rollers that are disposed to transport the sheet B along the transport path B1 and B2. In order to enable transporting of the sheet B by means of the second sheet conveyor device 2*b*, the sheet should first have cleared the first sheet conveyor device. To accomplish this, the transport rollers or the pressure rollers of the first sheet conveyor device 2*a* can be lifted off the sheet B in a controlled manner by means of a lifting mechanism 1000 as shown, for example, in FIG. 9 in order to release the sheet. Alternatively, such transport rollers may be configured as segmented roller, meaning that a portion of the transport roller body has a cut out segment. In a third case, a part of the circumference of such a transport roller may be flattened. During operation, a sheet B is passed between such a flattened transport roller or a segmented transport roller and an oppositely arranged pressure roller. As soon as the pressure roller and the segmented part or the flattened part are opposite each other, the sheet B is no longer held between the pressure roller and the transport roller and is thus released. In this manner, the sheet B is released in the same manner as if the transport roller and/or the pressure roller were lifted from the respective oppositely located roller.

Hereinafter, two embodiments of the sheet conveyor devices 2*a* and 2*c* are discussed in greater detail with reference to FIGS. 4 and 5. The sheet conveyor devices 2*a* and 2*c* comprise at least one sheet transport body 5 with a rotating mechanism 6 accommodated therein, the rotating mechanism enabling a rotation of the sheet transport body 5 about a first rotational axis 7 and a second rotational axis 8. The first rotational axis 7 and the second rotational axis 8 are perpendicular to one another and extend through one point of intersection 9. The rotational axis 7 is parallel to the first transport path B1.

In accordance with a particularly preferred embodiment, the first and the third sheet conveyor devices 2*a* and 2*e* are configured as dual sheet conveyor device 2*a*, 2*a* and 2*c*, 2*c* (see FIGS. 1, 2 and 3). This means that the first and third sheet transport devices 2*a* and 2*c*, respectively, comprise two mechanically coupled sheet transport bodies 5. In order to simplify the description a sheet conveyor device 2*a*, 2*c* comprising only one sheet transport body 5 containing a rotating mechanism 6 is described with reference to the schematic sectional view in accordance with FIG. 4. This means that only one half of a double sheet conveyor device 2*a*, 2*a* or 2*c*, 2*c* is described. Alternatively, the first and third sheet conveyor devices 2*a*, 2*c* can comprise only one sheet transport body 5. Furthermore, with the sheet turning unit 1, the double sheet conveyor devices 2*a*, 2*a* and 2*c*, 2*c* with two mechanically coupled sheet transport bodies 5 can be combined with the sheet conveyor devices 2*a*, 2*c* comprising only one sheet transport body 5.

Figure 4:
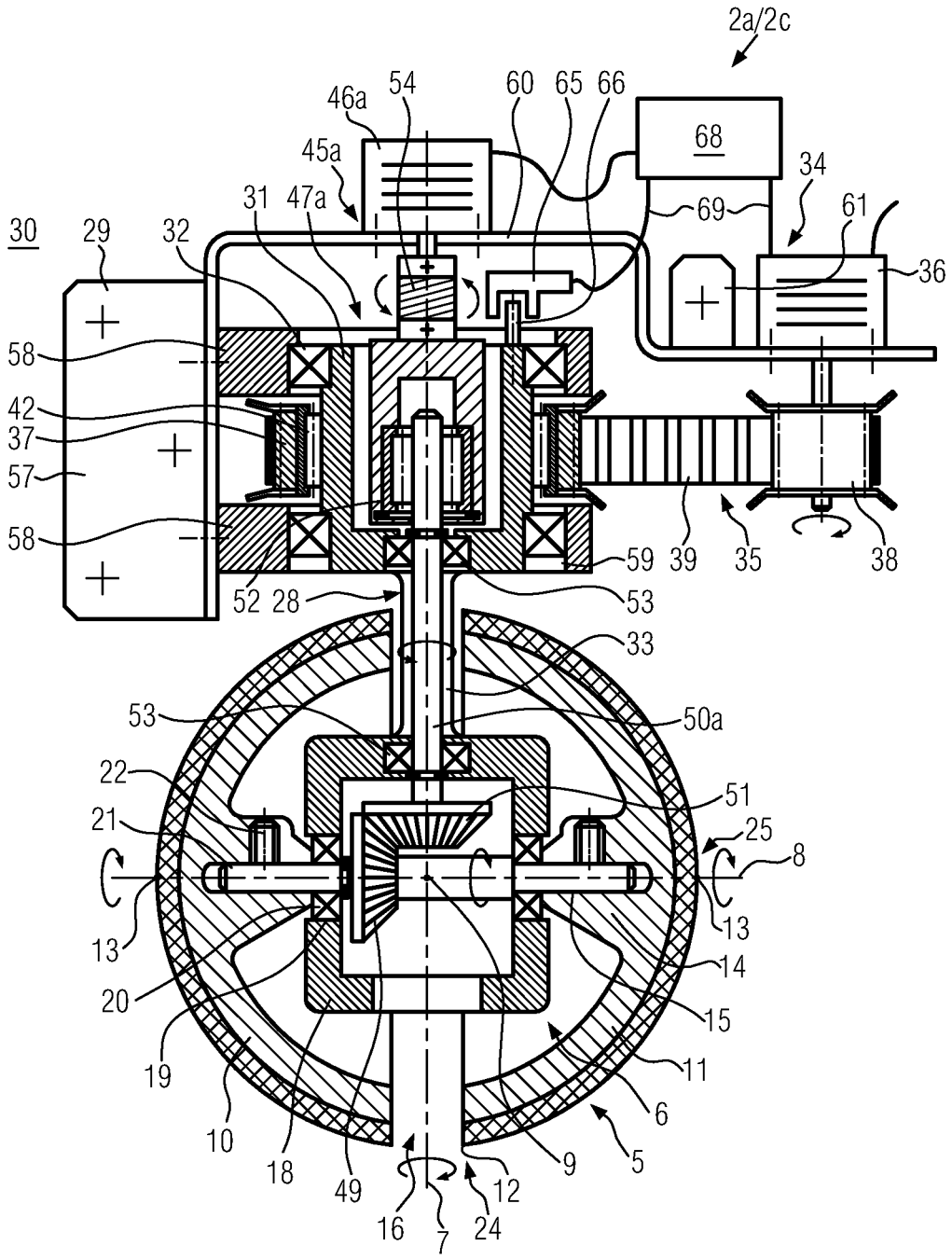
FIG. 4 a cross-sectional view of a first exemplary embodiment of a sheet conveyor device as in the present invention.

In the exemplary embodiment shown in FIG. 4 the sheet transport body 5 is spherical and comprises two half shells 10 and 11. However, it should be noted that in the exemplary embodiment shown in FIG. 4, as well as in the later-described exemplary embodiment of FIG. 5, the sheet transport body 5 may have a different form that is symmetrical relative to the two rotational axes 7, 8. For example, the sheet transport body 5 may have the shape of a body that is formed by the intersection of two equal-size cylinders whose center axes extend perpendicular to each other and through a common point of intersection.

The half shells 10, 11 are hollow and arranged so that their concave insides face each other. Each of the half shells 10, 11 has an edge 12 that delimits the half shells 10, 11. In addition, each of the half shells 10, 11 has a vertex 13 located in the center of the semi-spherical curvature of the outside of the half shells 10, 11. Also, each of the half shells has, opposite the vertex 13 on the concave inside of the respective half shell 10, 11, a projection 14 that consists of a thickened material region of the half shell 10 or 11. In the projection 14, there is a bore 15 each with a center axis corresponding to the rotational axis 8 of the sheet transport body 5, the bore being a pocket hole in FIGS. 4 and 5. The center axis of the bore 15 extends through the vertex 13 of each half shell 10, 11 and is located centered relative to the edge 12 of each half shell. The half shells 10, 11 are arranged somewhat at a distance from each other so that a slit 16 exists between them.

The rotating mechanism 6 comprises a carrier 18 having the form of a cube-shaped housing that is hollow on the inside. The carrier 18 has a bearing receptacle bore 19 extending from left to right in FIG. 4, the bore also being symmetrical relative to the second rotational axis 8. Two bearings 20, for example ball bearings, needle bearings or plain bearings, are arranged in the bearing receptacle bore 19. The two half shells 10, 11 are connected with each other by means of a half shell shaft 21 and supported so as to be rotatable relative to the carrier 19. The half shell shaft 21 extends through the two bearings 20, and its center axis corresponds to the second rotational axis 8. The half shell shaft 21 is secured with securing means in the projections 14 of the half shells 10, 11, for example, by means of a locking screw 22 (FIG. 4) or by means of an interference fit.

Two essentially ring-shaped transport paths 24, 25 extend on the sheet transport body 5 composed of the two oppositely arranged half shells 10, 11 in this manner. The centre axis of the transport path 24 is the second rotational axis 8, and the center axis of the transport path 25 is the first rotational axis 7. The first ring-shaped transport path 24 is formed by the edges 12 of the two half shells 10, 11 and extends around the sheet transport body 5. Furthermore, in the view of FIG. 4, the second transport path 25 extends, offset by 90° relative to the first transport path 24, around the sheet transport body 5, so that the transport path extends through the two vertices of the sheet transport body 5. The transport paths 24, 25 are, for example, rubberized regions on the half shells 10, 11, by means of which a high frictional force can be transmitted to a sheet B. In one exemplary embodiment, the half shells 10, 11 are completely rubberized on their outside.

A sheet metal support 29 that, in turn, is connected to a frame 30 of the printing machine 4 or other processing machine carries the sheet conveyor device 2*a*, 2*c*. The sheet conveyor device 2*a*, 2*c* is connected by means of a hollow shaft 28 having a bearing region 31 with the metal support sheet 29. In the exemplary embodiment of FIG. 4, the bearing region 31 is supported by two bearings 32 so as to be rotatable relative to the sheet metal support 29. The hollow shaft 28 has a thin region 33 that has an outside diameter that is smaller than the bearing region 31. On its one end, the thin region 33 is connected with the bearing region 31 and, on its other end, with the carrier 18. It should be noted that the bearing region 31, the thin region 33 and the carrier 18 may be manufactured of one part, for example of an injection molded part or a forged part, or that they may be joined to each other by welding. Inasmuch as the bearing region 31 can be rotated relative to the sheet metal support 29 and is rigidly connected with the carrier 18, the carrier 18 and the sheet transport body 5 connected therewith are also supported so as to be rotatable about the rotational axis 7 relative to the sheet metal support.

It should be noted that, in another exemplarily embodiment, as well as in the later described exemplary embodiment of FIG. 5, the bearing region 31 of the hollow shaft 28 could be rigidly connected with the sheet metal support 29. In such a case, the sheet transport body could be rotated only about the rotational axis 8.

The sheet conveyor device 2*a*, 2*c* further comprises a first driving unit 34 that comprises a first driving motor 36, preferably an electric stepper motor, as well as a first driving mechanism 35 that connects the sheet transport body 5 with the first driving motor 36. The first driving motor 36 is rigidly connected with the sheet metal support 29 and is intended to generate a rotation of the half shells 10, 11 of the sheet transport body 5 about the rotational axis 7. The first driving mechanism 35 comprises the hollow shaft 28, a first pulley 37 connected with the hollow shaft 28, a second pulley 38 and a belt 39. The second pulley 38 is attached to the output shaft of the first driving motor 36 and rotates therewith. By means of a freewheel 42, the first pulley 37 is attached to the bearing region 31 of the hollow shaft 28. The freewheel 42 enables a torque to be transmitted in one direction of rotation about the rotational axis 7 by means of the first driving unit 36, whereas a torque in the direction opposite the direction of rotation about the rotational axis 7 cannot be transmitted. In other words: The hollow shaft 28 and the sheet transport body 5 connected therewith can be freely rotated in one direction about the rotational axis 7.

It should be noted that the freewheel 42 is not necessarily required for the function of the sheet conveyor device 2*a*, 2*c*; this, incidentally, also being applicable to the later described exemplary embodiment of FIG. 5. However, by providing the freewheel 42, it is possible—in a situation in which a sheet B is to be transported in the printing machine 4 in a transport direction of the first transport path 24—that the sheet B can be transported away at increased speed. In this instance, it is not necessary to de-energize the driving motor 36, and, likewise, the motor cannot be damaged by an increased transport speed of a sheet B.

The sheet conveyor device 2*a*, 2*c* also comprises a second driving unit 45*a* that comprises a second driving motor 46*a*, preferably an electric stepper motor, as well as a second driving mechanism 47*a*. The second driving mechanism 47*a* connects the sheet transport body 5 with the second driving motor 46*a*. The second driving motor 46*a* is rigidly connected with the sheet metal support 29 and is intended to generate a rotation of the half shells 10, 11 of the sheet transport body 5 about the rotational axis 8.

The second driving mechanism 47*a* comprises a first bevel gear 49 that is rigidly connected with the half shell shaft 21 and is located in the interior space of the carrier 18 between the two bearings 20. Furthermore, the second driving mechanism 47*a* comprises a driveshaft 50*a* which is arranged inside the hollow shaft 28 and can be rotated relative to the shaft. The driveshaft 50*a* extends from the interior space of the carrier 18 through the thin region 33 of the hollow shaft 28 up to and into the bearing region 31. On its one end, the driveshaft 50*a* is connected to a second bevel gear 51, the gear also being located inside the interior space of the carrier 18 and meshing with the first bevel gear 49. The second end of the driveshaft 50*a* is connect with a second freewheel 52 that enables the transmission of a torque in a direction of rotation about the rotational axis 7 and that prevents a rotation in the opposite direction of rotation. Via bearings 53 that are attached in the carrier 18 and in the bearing region 31 of the hollow shaft 28, the driveshaft 50*a* is supported so as to be rotatable relative to the hollow shaft 28 and the carrier 18. It should be noted that the bearings 53 in a not shown exemplary embodiment may be alternatively arranged only in the hollow shaft 28. The second driving mechanism 47*a* further comprises a clutch 54 located between the second driving motor 46*a* and the freewheel 52. The clutch 54 may be, for example, an electrical or mechanical clutch that makes it possible to connect or disconnect the second driving motor 46*a* and the second driving mechanism 47*a*. Depending on the use of the sheet conveyor device 2*a*, 2*c*, the freewheel 52 or the clutch 54 may be omitted.

The sheet metal support 29 acts as a housing or holder for the sheet conveyor device 2*a*, 2*c* and as a connecting element of the sheet conveyor device 2*a*, 2*c* with the frame 30 of the printing machine 4. In particular, the sheet metal support 29 offers a mounting option for the first and second driving motors 36, 46*a*, as well as a rotatable support of the hollow shaft 28 via the bearings 32. As can best be seen in FIG. 4, the sheet metal support 29 has a fastening component 57 for connection with the frame 30 of the printing machine 4. Extending away from the fastening component 57 there are two bearing holders 58 that have a bearing bore 59 wherein the bearings 32 for the hollow shaft 28 are arranged. Furthermore, the sheet metal support 29 has a motor holding component 60 that extends away from the fastening component 57 toward the right in FIG. 4 and generally has an S-form. The first and second driving motors 36, 46*a* are mounted to the motor mounting component 60, for example, by means of rivets or screws. Between the first and the second driving motors 36, 46*a* extending away from the motor mounting component 60, there is a mounting tab 61. The mounting tab 61 is intended for stabilizing and fastening the sheet metal support 29 on the frame 30 of the printing machine 4.

Furthermore, the sheet conveyor device 2*a*, 2*c* comprises a position sensor 65 that is fastened to the motor mounting component 60 of the sheet metal support 29. The position sensor 65 may be any suitable sensor for detecting a rotary position of the hollow shaft, for example an encoder, a magnetic sensor or an optical sensor. In the exemplary embodiment of FIG. 4, the position sensor 65 is an optical sensor, for example a fork light barrier that is able to detect a position pin 66. The position pin 66 is fastened to the bearing region 31 of the hollow shaft 28 and enables the detection of a rotary position of the hollow shaft 28. The position sensor 65 outputs an output value to a control device 68 as soon as the sensor has detected the presence of the position pin 66 in its region of detection. The position pin 66 and the position sensor 65 are arranged with respect to the sheet metal support 29 in such a manner that, when the presence of the position pin 66 is detected by the position sensor 65 the two half shells 10, 11 of the sheet transport body 5 are aligned in the position shown in FIG. 4. This means that the rotational axis 8 extends in the plane of projection of FIG. 4, and the half shells 10, 11 are erected in such a manner that their edges 12 are aligned perpendicularly with respect to the plane of projection of FIG. 4. While the two half shells 10, 11 are being rotated about the rotational axis 8, a sheet B that is not shown in FIGS. 4 and 5 and that is to be transported in the direction of the rotational axis 7, can be transported without a rotary motion being forced on it. A transport of a sheet B in a conveying direction in the direction of the rotational axis would, as it were, also be possible if both half shells 10, 11 were not arranged in the alignment shown in FIG. 4; however, then the sheet to be transported B would then be forcefully impaired with a rotary motion.

The sheet transport device 2*a*, 2*c* is connected with the control device 68. In particular, the control device 68 is connected by connecting lines 69 with the first driving motor 36, the second driving motor 46*a* and the position sensor 65. The control device 68 may be a control device specifically provided for the sheet transport device 2*a*, 2*c*; however, it may also be a control device for several sheet transport devices and/or be an integral part of a general control device for a processing machine or the printing machine 4.

As mentioned hereinabove, the sheet conveyor devices 2*a*, 2*c* in the exemplary embodiment shown in FIGS. 1, 2 and 3, respectively comprise two sheet transport bodies 5 and thus are embodied as double sheet conveyor devices 2*a*, 2*a* or 2*c*, 2*c*. The sheet metal supports 29 and the first and second driving units 34, 45*a* of the double sheet conveyor devices 2*a*, 2*a* or 2*c*, 2*c* are accommodated in a carrier housing 62 that is best seen in FIG. 3. The carrier housing 62 is connected with the frame 30 of the printing machine 4 and supports the sheet conveyor devices 2*a* and 2*c* relative to the frame 30. The hollow shaft 28 projects in the direction of the transport path B1, B3 from the carrier housing 62 and supports the respective sheet transport bodies 5. In a preferred exemplary embodiment, the two sheet transport bodies 5 of a double sheet conveyor device 2*a*, 2*a* or 2*c*, 2*c* are driven by a common first driving unit 34 and by a common second driving unit 45*a*. The first common driving unit 34 is designed in such a manner that the hollow shafts 28 of the two sheet transport bodies 5 are connected with each other and thus can be driven by a single first driving motor 36. In the same way, the driveshafts 50*a* of the second driving unit 45*a* of the two sheet transport bodies 5 are connected with a common driving motor 46*a*.

This saves costs for several driving motors, and, furthermore, it is not necessary to operate several driving motors synchronously in order to bring the sheet transport body 5 of one double sheet conveyor device 2*a*, 2*a* or 2*c*, 2*c* into synchronous mode.

Hereinafter, the functions of the first driving unit 34 and of the position sensor 65 are described. As mentioned above, the sheet metal support 29 is fastened to the frame 30 of the printing machine 4 and supports the sheet transport device 2*a*, 2*c*. The sheet transport body 5 is supported by means of the carrier 18 and the hollow shaft 28 so as to be rotatable relative to the sheet metal support 29. As soon as the first driving motor 36 of the first driving unit 34 begins to rotate, the first driving mechanism 35, i.e., the first and second pulleys 37, 38, the belt 39, the freewheel 42 and the hollow shaft 28, is also driven in order to rotate about the rotational axis 7. Finally, the rotary motion of the hollow shaft 28 is transmitted to the carrier 18 and the sheet transport body 5, the latter ultimately also rotating about the rotational axis 7.

A sheet B in contact with the sheet transport body 5 is driven to the left or right in FIG. 4 by the first transport path 24, the driving direction depending on the direction of rotation of the driving motor 36. In an exemplary embodiment, wherein no freewheel 42 is provided, a sheet B can be transported in any direction, i.e., to the left or to the right, whereas in an exemplary embodiment, wherein the freewheel 42 is provided, the sheet B can be driven in only one direction and can be freely pulled off in the other direction or cannot be driven.

With the rotation of the hollow shaft 28, the position pin 66 is also moved on an orbit and, during each revolution, passes the position sensor 65. Each time the position pin 66 passes the position sensor 65, the position sensor 65 releases an output signal that is input in the control device 68. Based on the output signal the control device 68 can detect the position of the sheet transport body 5. The position sensor 65 and the position pin 66 are arranged in such a manner that, in case of a superimposition and thus the release of an output signal by the position sensor 65, the slit 16 between the first and the second half shells 10, 11 is in a position perpendicular to the plane of projection of FIG. 4. Then, the control device 68 is able to stop the driving motor 36, as soon as the slit 16 is aligned perpendicular to the plane of projection of FIG. 4.

Hereinafter, the function of the second driving unit 45*a* will be explained. As soon as the second driving motor 46*a* is energized, the motor generates an output of a rotary motion about the rotational axis 7. Under condition that the clutch 54 is in engagement, the rotation of the driving motor 46*a* is transmitted to the freewheel 52. The freewheel 52 transmits the rotation of the second driving motor 46*a*, in so far as it acts in a direction that can be transmitted by the freewheel 52 to the driveshaft 50*a*. The driveshaft 50*a*, in turn, rotates the second bevel gear 51 located on the end of the driveshaft, the bevel gear being in engagement with the first bevel gear 49. Due to the rotation of the two bevel gears 49 and 51, the transversely extending half shell shaft 21 is finally put in rotation, this causing the two half shells 10, 11 to jointly rotate about the second rotational axis 8. The sheet transport body 5 thus performs a rotation about the second rotational axis 8. A sheet B in contact with the sheet transport body 5 is transported in the direction of the rotational axis 7 upward or downward in FIG. 4.

It should be noted that the second driving unit 45*a* is designed in such a manner that, during operation of the first driving unit 34, the driveshaft 50*a* and the second bevel gear 51 attached thereto can move freely with the sheet transport body 5. This can also be reliably ensured, in the manner described hereinafter, in an embodiment, wherein neither the clutch 54 nor the freewheel 52 are provided. The first and simplest option is that the clutch 54 is out of engagement, and no torque can be transmitted between the driving motor 46*a* and the driveshaft 50*a*. The second option is that the clutch 54 is in engagement as it were; however, the first driving unit 36 drives the sheet transport body 5 in a direction in which the freewheel 52 of the second driving unit 45*a* moves freely and thus does not transmit any torque to the driveshaft 50*a*.

At this point the interplay between the first and the second driving units 34, 45*a* in an embodiment will be discussed, said embodiment comprising neither the clutch 54 nor the freewheel 52. In such a design, the driveshaft 50*a* and the bevel gear 51 connected therewith would stop with the driving motor 46*a* switched off. If, in such a case, the hollow shaft 28 and thus the carrier 18 were put into rotation by the first driving unit 34, the first bevel gear 49 would roll off the stationary second bevel gear 51 and thus effect a rotary motion of the half shells 10, 11 about the rotational axis 8. Then the sheet transport body 5 would perform a rotary component in the direction of the rotational axis 7 and, at the same time perform another rotary component in the direction of the rotational axis 8. A precise rotation and thus a precise transport of a sheet B in one of the two transport directions would not be possible in this case.

Starting with this idea, another exemplary embodiment is taken into consideration, the embodiment having the same design as shown in FIG. 4, wherein, however, none of the freewheels 42, 52 and no clutch 54 are provided. In such a case, the driving motors 36 and 46*a* are directly connected with the driveshaft 50*a* or the hollow shaft 28. The driving motors 36, 46*a* are controlled by the control device 68 in such a manner that, when a sheet B is transported for example in the direction of the transport direction from left to right in FIG. 4, the driveshaft 50*a* and the hollow shaft 28 rotate with the same rotational speed. Thus it is not possible that the bevel gear 49 rolls off the bevel gear 51. Additionally, due to the relative rotational speed differences between the driving motor 36 and the driving motor 46*a* rotations and oblique transport directions of the sheet B can be generated.

Figure 5:
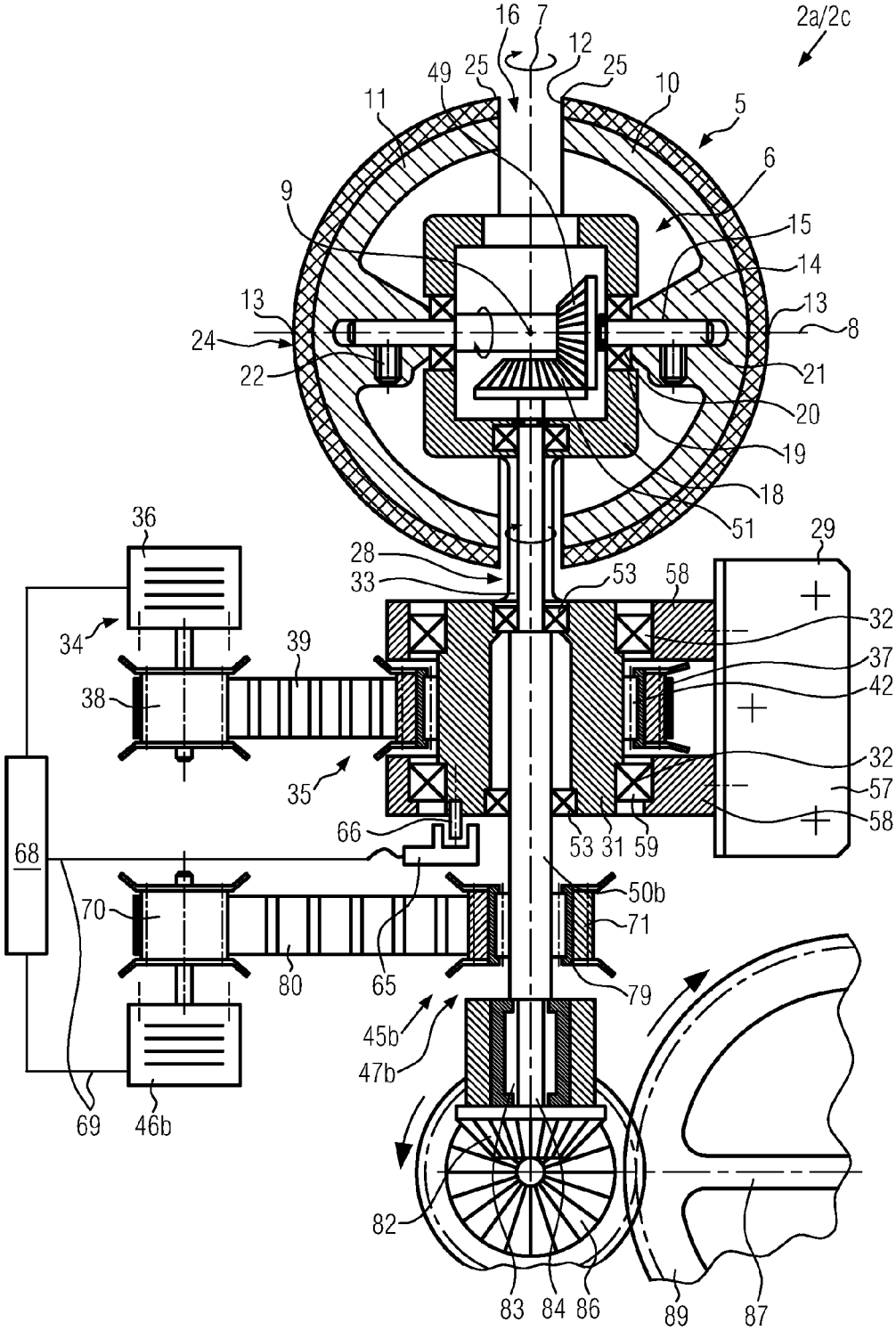
FIG. 5 a cross-sectional view of a second exemplary embodiment of a sheet conveyor device as in the present invention.

FIG. 5 shows another exemplary embodiment of a sheet conveyor device 2*a*, 2*c* that is designed similarly as the sheet conveyor device 2*a*, 2*c* in FIG. 4. In FIG. 5, the parts and features of the sheet conveyor device 2*a*, 2*c* that have already been described relating to the exemplary embodiment of FIG. 4 have been identified with the same reference signs as in FIG. 4. For simplification, a repeated description of these parts and features is omitted here. The sheet conveyor device 2*a*, 2*c* of FIG. 5 is mainly different from the embodiment of FIG. 4 due to the embodiment of the second driving unit. The sheet conveyor device 2*a*, 2*c* comprises a second driving unit 45*b* that is different from the second driving unit 45*a* of the embodiment shown in FIG. 4.

The second driving unit 45*b* comprises a second driving motor 46*b* and a second driving mechanism 47*b* arranged between the second driving motor 46*b* and the sheet transport body 5. The second driving motor 46*b* again is an electric stepper motor in the exemplary embodiment of FIG. 5. The first driving motor 36, the second driving motor 46*b* and the position sensor 65 are connected with the control device 68.

The second driving mechanism 47*b* comprises a pulley 70 that is attached to the driveshaft of the second driving motor 46*b*, furthermore a driveshaft 50*b* that, like the driveshaft 50*a* in the exemplary embodiment of FIG. 4, extends through the hollow shaft 28 of the first driving unit. The driveshaft 50*b* has a first end that is located in the hollow interior space of the carrier 18. As in the case of the embodiment of FIG. 4, the second driving mechanism 47*b* further comprises first bevel gear 49 that is connected with the half shell shaft 21, as well as a second bevel gear 51 that is attached to the end of the driveshaft 50*b*, said second bevel gear being located inside the hollow interior space of the carrier 18. The driveshaft 50*b* is also supported via bearings 53 relative to the support 18 and to the hollow shaft 28. The second driving mechanism 47*b* further comprises a second pulley 71 that is arranged on the opposite end of the driveshaft 50*b* by means of a freewheel 79, said driveshaft projecting from the hollow shaft. Furthermore, the second driving mechanism 47*b* comprises a belt 80 that is passed around the first and the second pulleys 70, 71 and makes it possible that a rotary motion is transmitted by the first pulley 70 to the second pulley 71 and thus to the driveshaft 50*b*. The freewheel 79 enables a transmission of torques in one direction of rotation, whereas said freewheel does not allow a transmission of torques into the other direction of rotation. The pulley 71 can be rotated freely on the driveshaft 50*b* in this second direction of rotation.

The second driving mechanism 47*b* further comprises a bevel gear 82 that is connected with the driveshaft 50*b* by means of a freewheel 83. In the exemplary embodiment shown in FIG. 5, the driveshaft 50*b* has a tapered section 84, in the region of which the freewheel 83 is arranged on the driveshaft 50*b*. The freewheel also enables a transmission of torque in one direction of rotation, whereas it does not allow a transmission of torque in the other direction of rotation, so that the bevel gear 82 can rotate freely relative to the driveshaft 50*b* in this rotation direction. The bevel gear 82 of the second driving mechanism 47*b* is in engagement with a bevel gear 86 having a rotational axis extending perpendicularly to the plane of projection of FIG. 5. The bevel gear 86, in turn, is in direct engagement—or via an additional toothed gear (not specifically identified)—in engagement with the driving gear 87. The driving gear 87 is again driven directly or via additional components of the printing machine 4. Consequently, it is possible that the second driving mechanism 47*b* is driven by means of the driving motor 46*b* or by means of a rotation of the driving wheel 87 and the bevel gear 86.

The mode of operation of the sheet conveyor device 2*a*, 2*c* in FIG. 5 is similar to that of the sheet conveyor device 2*a*, 2*c* in FIG. 4. Driving of the sheet conveyor device 2*a*, 2*c* in FIG. 5 by means of the first driving unit 36 is accomplished in the same manner as described above, hence this will not be repeated again. Driving of the sheet conveyor device 2*a*, 2*c* by means of the second driving unit 45*b* is possible in two ways.

The first option is that the driving motor 46*b* is instructed by the control device 68 of the printing machine 4 to perform a rotation, as a result of which the pulley 70 is put into rotation. By means of the belt 80, the drive output of the driving motor 46*b* is transmitted to the pulley 71 and, finally, to the driveshaft 50*b* of the second driving mechanism.

The second option is that the driving gear 87 puts the bevel gear 86 into rotation, as a result of which the bevel gear 82 being in engagement therewith will be driven. The rotation of the bevel gear 82 is transmitted by means of the freewheel 83 to the tapered section 84 of the driveshaft 50*b*. Depending on the configuration of the freewheels 79 and 83 it is possible that the pulley 71 and the bevel gear 86 provide a driving of the driveshaft 50*b* in the same direction, however at different speeds. For example, a driving by means of the driving motor 46*b* via the belt 80 and the pulley 71 can result in a slow rotation of the driveshaft 50*b*, whereas a drive by means of the bevel gears 82 and 86 can result in a fast rotation of the driveshaft 50*b*. However other combinations of the freewheels are also possible.

Like in the exemplary embodiment of FIG. 4, the embodiment of FIG. 5 does however require that a freewheel be provided for the driveshaft 50*b*, so that the driveshaft does not hold the bevel gear 51 in a stationary manner relative to the sheet metal support 29, because, otherwise, the bevel gear 49 would co-rotate and cause an undesirable rotation of the half shells 10, 11.

A pressure roller 70 that enables a rolling motion in several directions is positioned opposite each of the sheet transport bodies 5 of the sheet conveyor devices 2*a* and 2*c*. The pressure roller 72 comprises a pressure roller body 73, a pressure roller carrier 74, and rolling elements 75 that is arranged between the pressure roller body 73 and the pressure roller carrier 74. The pressure roller body 73 is spherical, and the pressure roller carrier 74 has an essentially semi-spherical receptacle opening 76 that is disposed to receive the pressure roller body 73. The rolling elements 75 are supported in the concave opening 76 by means of a not shown rolling element cage and support the pressure roller body 73 relative to the pressure roller carrier 74. The rolling elements 75 are spheres and enable a rotation of the spherical pressure roller body 73 in each direction. The pressure roller carrier 74 is resiliently mounted relative to the frame 30 of the printing machine 4, so that the pressure roller body 73 is pushed toward the sheet transport body 5 of the sheet conveyor devices 2*a* and 2*c*.

A sheet B that is supplied along the first transport path B1 is held between the sheet transport body 5 and the pressure roller body 73, whereby the holding force is defined by the resilient bearing of the pressure roller carrier 74. Depending on whether the sheet transport body 5 rotates about the center axis 7 or the center axis 8, the pressure roller body 73 of the pressure roller 72 rotates about a center axis that is parallel to the rotational axis 7 or 8. Consequently, the pressure roller 70 enables a transport of the sheet B in the direction of the transport path B1 or in the direction of the transport path B2.

As can also best be seen in the plan view of FIG. 3, in the preferred exemplary embodiment described here, a first double sheet conveyor device 2*a*, 2*a* with two sheet transport bodies 5 is arranged on the upper supplying side in the plane E1 (not shaded). On the lower delivering side in plane E2, however, two double sheet conveyor devices 2*c*, 2*c* with a total of four sheet transport bodies 5 are arranged. Such an arrangement, wherein a smaller number of the sheet transport bodies 5 is being used on the upper supplying side in plane E1 than on the lower delivering side in plane E2 is of advantage with different sheet lengths. When a sheet B is supplied along the transport path B 1, said sheet can be brought by a first sheet conveyor device 2*a* comprising one or more sheet transport bodies 5 into position to the point where a transfer to the second sheet conveyor device 2*b* is possible. Depending on the length of the sheet B the sheet B then projects more or less far from the last sheet conveyor device 2*a* or 2*a*, 2*a* in plane E1. During delivery in the second plane E2 by the third sheet conveyor device 2*c* or 2*c*, 2*c*, however, the entire length spectrum of the sheets B to be processed must be taken into account. The shortest, as well as the longest sheet B must be reliably transferred to the subsequent transport path B3, without ever losing contact with the third sheet conveyor device 2*c* or 2*c*, 2*c*.

The second sheet conveyor device 2*b* comprises several large drive wheels 100 that have a grippy surface on their circumference, for example, a rubberized surface. These drive wheels 100 have a sufficiently large diameter that takes into account the stiffness of thicker sheets B and prevents that thick sheets B are bent excessively. A suitable diameter of the driving wheels 100 is at approximately 200 mm. The driving wheels 100 are mounted to a common driveshaft 102 that is aligned parallel to the first and third transport paths B1 and B3. The diameter of the driving shells 100 corresponds to the distance of the two planes E1 and E2. This means, a sheet B that has been supplied along the upper supplying transport path B1 is arranged tangentially with respect to the upper part of the driving wheels 100. A sheet B that is located in the lower plane E2 in the third transport path B3 is arranged tangentially with respect to the lower part of the driving wheels 100. The driveshaft 102 is connected with a driving motor 104 via a clutch 103. Pressure rollers 106 are arranged on the outside circumference of the driving wheels 100, the pressure rollers being supported so as to be resilient relative to the driving wheels 100. Furthermore, the second sheet conveyor device 2*b* comprises a directional baffle 108 that is best seen in the view of FIG. 1. The directional baffle 108 extends at a small distance from the outside circumference of the driving wheels 100 and has an essentially semi-cylindrical shape. The distance between the directional baffle 108 and the outside circumference of the driving wheels 100 is large enough for a sheet B of any prespecified thickness of the entire spectrum of sheets B to be received between the directional baffle 108 and the outside circumference of the driving wheels 100. The directional baffle 108 has at points where the pressure rollers 106 contact the outside circumference of the driving wheels 100, recesses or holes, in order to enable a contact of the pressure rollers 106 with the sheet B or the driving wheels 100 (see FIG. 1).

During operation of the sheet turning unit 1, a sheet B is delivered in the first plane E1 along the transport path B1 by means of the first sheet conveyor device 2*a*. This is accomplished by a rotation of the sheet transport body 5 about the center axis 8. The first sheet conveyor device 2*a* stops conveying the sheet B in the direction of the transport path B1 as soon as the sheet B is arranged fully in the region of the driving wheels 100. The sheet B is then in a position in which the sheet can be conveyed at an angle of 90° to the transport path B1 in the direction of the transport path B2 along the outside circumference of the driving wheels 100.

In order to convey the sheet B in the direction of the transport path B2, the first sheet conveyor device 2*a* transports the sheet to the left, in the view of FIG. 1, to the second sheet conveyor device 2*b*. This is accomplished by a rotation of the sheet transport body 5 about the center axis 7. Between the uppermost pressure rollers 106 and the driving wheels 100 of the second sheet conveyor device 2*b*, the sheet B is gripped and transported in the direction of the second semi-circular transport path B2. The directional baffle 108 guides the sheet B along the second transport path B2 along the circumference of the driving wheels 100. The conveying speed along the second transport path B2 depends on the speed of the driving motor 104 and may be a higher speed, as described above. A damage of the sheet conveyor device 2*a* can be prevented by the aforementioned freewheels 52 and 42.

After moving through the second sheet conveyor device 2*b*, the sheet B is transferred to the third sheet conveyor device 2*c*. The sheet transport bodies 5 of the third sheet conveyor device 2*c* thus first again perform a transverse rotation about the center axis 7 so that the sheet B moves to the right in the view of FIG. 1. As soon as the sheet B comes out of engagement with the driving wheels 100 and the associated pressure rollers 106, the third sheet conveyor device 2*c* or 2*c*, 2*c* transports the sheet B further in the direction of the sheet transport path B3 parallel to the sheet transport path B1, however, in the lower plane E2.

In an exemplary embodiment not shown in the figures, the second sheet transport device 2*b* comprises several transport rollers instead of the driving wheels 100, said transport rollers being arranged along the second transport path B2 opposite the pressure rollers 106. In this case, the second sheet transport path B2 may also be semi-circular and, for example, have a radius of 100 mm, this corresponding to the diameter of 200 mm of the aforementioned driving wheels 100. However, the second transport path B2 may also be oval or have another advantageous form adapted to the spatial conditions inside the printing machine 4 and prespecified by the directional baffle 108. In such an embodiment of the second sheet conveyor device 2*b*, the sheet B would be transported by the driven transport rollers along the second transport path B2, in which case the driving speed of the transport rollers is synchronous so that the sheet B will not throw waves.

In all embodiments of the second sheet conveyor device 2*b* the second transport path B2 extends at an angle of 90° with respect to the first transport path and describes, in sum, a curve of 180°, the starting point of said curve being in the first plane and the end point of said curve being in a second plane that is different from the first plane. The second transport path B2 may, for example, also include two curves of 90° and one or more straight sections. Alternatively or additionally, the second transport path B2 may take a convoluted course with convex and concave curves and straight sections, as long as the curves, in sum, result in a curve of 180°. Thus the sheet B is ultimately turned in the course of the second transport path B2. Such a second transport path B2 can be used when the available installation space for the sheet turning unit 1 is small and/or when the sheet B must be guided around the components of the printing machine 4.

Figure 6A:
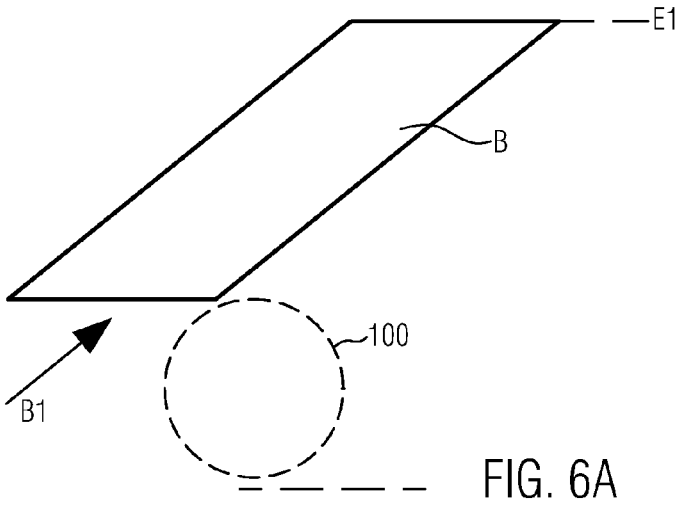
Figure 6B:
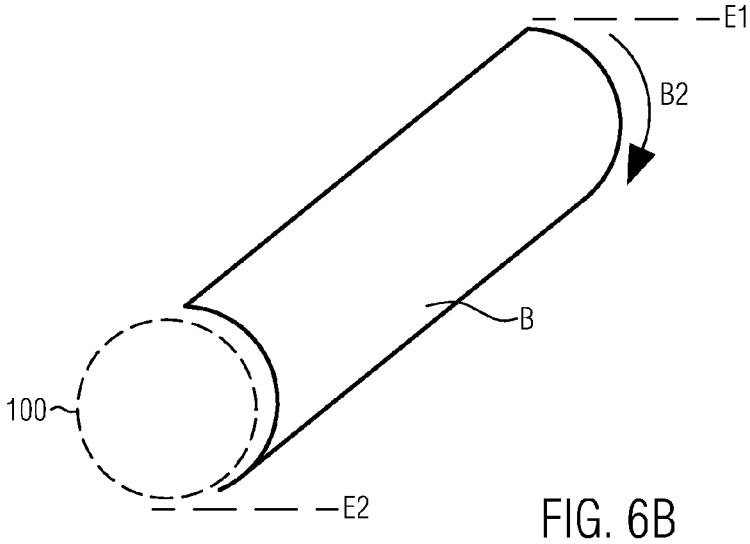
Figure 6C:
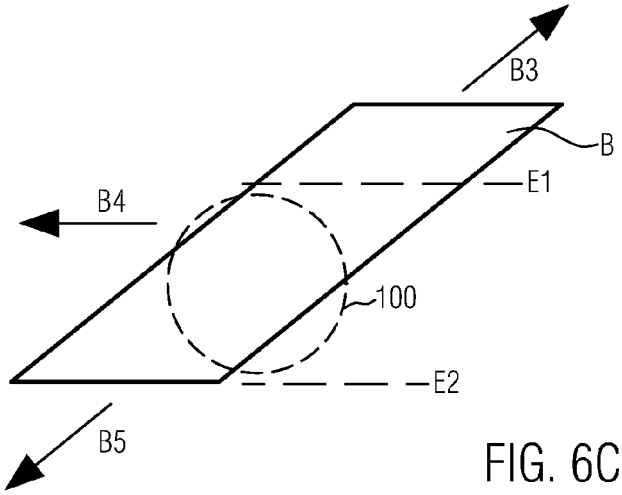
FIG. 6C illustrates the delivery of a sheet in several possible sheet transport directions.

FIG. 6 shows the movement of a sheet B along the first, second and third transport paths B1, B2 and B3. The driving wheels 100 are indicated in dashed lines in order to illustrate the movement of the sheet B relative to the driving wheels. In FIG. 6A, the sheet B is supplied along the first transport path B1. In FIG. 6B it can be seen how the sheet B is transported at an angle of 90° relative to the first transport path B1 along the transport path B2 around the driving wheels 100 and, in doing so, turned. FIG. 6C shows how the sheet B is transported away along the third transport path B3. The third transport path B3 is parallel to the first transport path B1 and extends in the same direction, however, said third path is located in the plane E2.

FIG. 6C also shows two exemplary embodiments, wherein the sheet B is transported along alternative transport paths B4 or B5 instead of in the direction of the transport path B3. The transport path B4 is also located in plane E2 and continues the movement of the sheet B in the direction of the transport path B2. This means that the sheet B moves around the driving wheels 100 and is further delivered on the level of plane E2, without any directional change. The transport path B5 is also in plane E2 and is parallel to the transport path B3, however, extends in opposite direction. This means, in the case of a transport along the transport path B5, the sheet B is conveyed along the second transport path B2 and then again transported back in the direction from where it was initially supplied.

Figure 7:
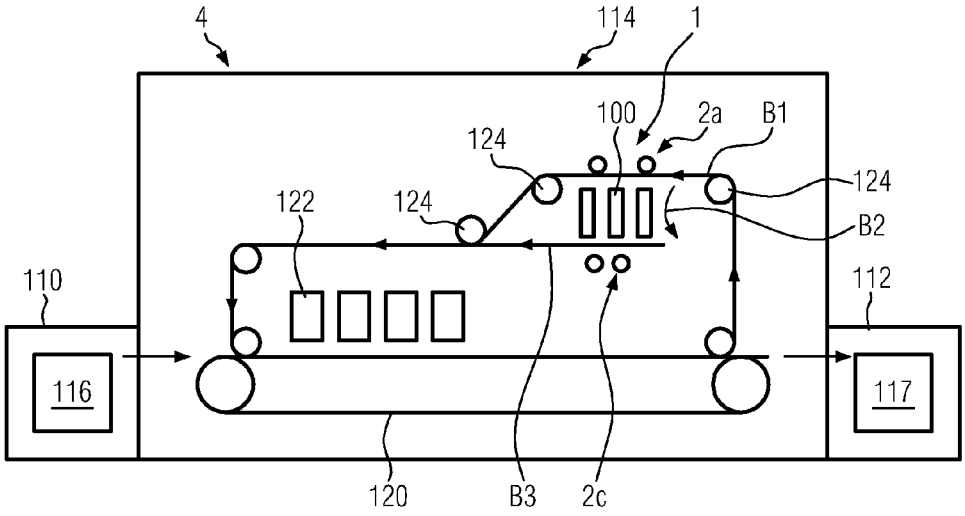
FIG. 7 a schematic side view of a printing machine, the view illustrating the sheet turning unit of the present invention in a first possible application.
Figure 8:
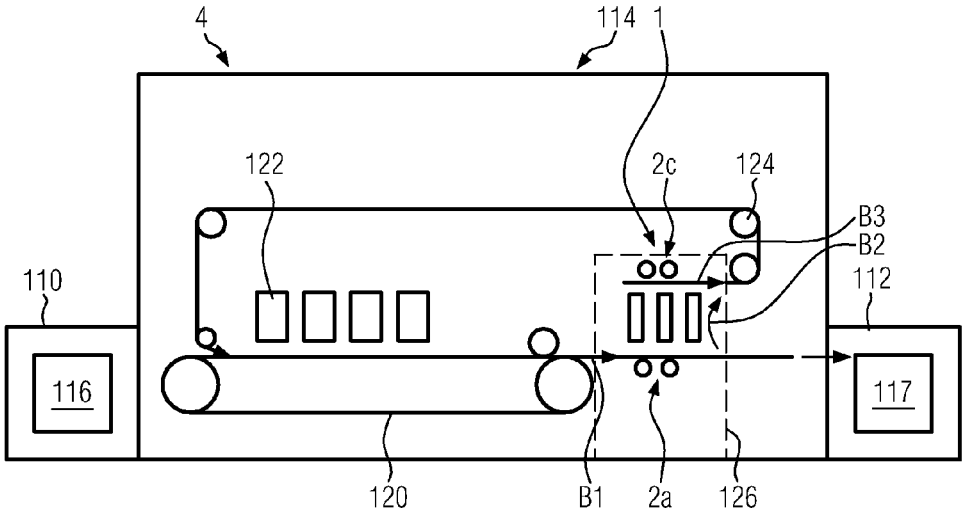
FIG. 8 a schematic side view of a printing machine, the view illustrating a sheet turning unit of the present invention in a second possible application.

FIGS. 7 and 8 show application options for the sheet turning unit 1. The sheet turning unit 1 is arranged in the printing machine 4, the printing machine comprising a feeder 110, a stacker 112 and—arranged between the feeder 110 and the stacker 112—a processing region 114. Situated in the feeder 110 is a stack of sheets B to be printed and in stacker 112 is a stack of sheets 117 of completely printed sheets B. In the processing region 114, there is a conveyor device 122 through which the sheets B can be transported through the processing region 114. The conveyor device 122 may be a transport belt, for example. Additionally arranged in the processing region 114, there are several processing units 122, for example print heads. A sheet B of the sheet stack 116 is supplied in the feeder 110 and moved past the processing units 122 by means of the conveyor device 122. There, the sheet B is processed by the processing units 122, for example, it is being printed, punched, perforated or cut.

As is shown by FIG. 7, the sheet B—in order to have it also processed from the other side—can subsequently be moved along the transport path B1 of the sheet turning unit 1. In the sheet turning unit 1, the sheet B is transported along the second transport path B2 and turned. Finally, the sheet B is transported away along the transport path B3. The leading edge of the sheet B continues to be in front after the turning operation. The transport path B3 then leads back in the direction of the processing units 122.

In the arrangement of FIG. 7, it is also possible to allow the sheet B to move through without any turning operation by the sheet turning unit 1. In this case, the sheet B is simply continued to be moved through the first sheet conveyor device 2*a* along the transport path B1. To accomplish this, the sheet B is guided by means of the deflecting rollers 124 on an S-shaped path off the plane E1 onto the plane E2. In this manner, the sheet B can again be processed from the same side as in the first pass through the processing units 122.

FIG. 8 shows another application option of the sheet turning unit 1. In this instance, the sheet B is supplied from the sheet stack 116 in the feeder 110 to the conveyor device 122 and passed through the processing units 122. After passing through the processing units 122, the B is delivered to the sheet turning unit 1. This means that the first transport path B1 starts at the end of the conveyor device 122. Plane E1 in FIG. 8 is on the level of the conveyor device 122, and plane E2 is above that.

In a first case, the sheet B is completely processed after passing through the processing units 122 and should be delivered to the sheet stack 117 in the stacker 112. In this first case, the sheet B is not turned by the sheet turning unit 1 but is simply transported further in the direction of the sheet stack 117 in plane E1 by means of the first sheet conveyor device 2*a*.

In a second case, the sheet B is to be turned and also to be printed or processed from the other side. In this case, the sheet B is also delivered on the plane E1 along the first transport path B1 to the sheet turning unit 1. After the first sheet conveyor device 2*a* has completely delivered the sheet B into the sheet turning unit 1, the sheet B is conveyed along the semicircular transport path B2 to the second plane and, in doing so, turned. After the turning operation, the third sheet conveyor device 2*c* transports the sheet B in the direction of the third transport path B3. Then, the sheet B is again guided by the deflecting rollers 124 back to the conveyor device 122 in order to be processed on its reverse side by the processing units 122.

If the sheet turning unit 1 is installed in the printing machine 4 or in another processing machine in a manner as shown in FIGS. 7 and 8, the functions of a turning unit, a simplex/duplex reversal and a diverter can be implemented. Consequently, a sheet B can be printed from one side or from both sides, can be printed multiple times from one side or multiple times from both sides, etc.

Furthermore, a sorting function of the sheet turning unit 1 is taken into consideration and discussed with reference to FIG. 8. Depending on how a sheet B is continued to be processed, the sheet B—as shown in FIG. 6—can be transported away in different directions (transport paths B3, B4, B5). In order to implement a sorting function, a second feeder 126 (shown in dashed lines in FIG. 8) is provided in order to accept processed sheets B. Thus a sheet B can be transported either further along the transport path B3 (from left to right in FIG. 8) in order to be finally deposited on the sheet stack 117 in the first stacker 112, or the sheet B can be transported away along a transport path B4 perpendicular to the plane of projection of FIG. 8 in order to be delivered to the second stacker 126.

Figure 9:
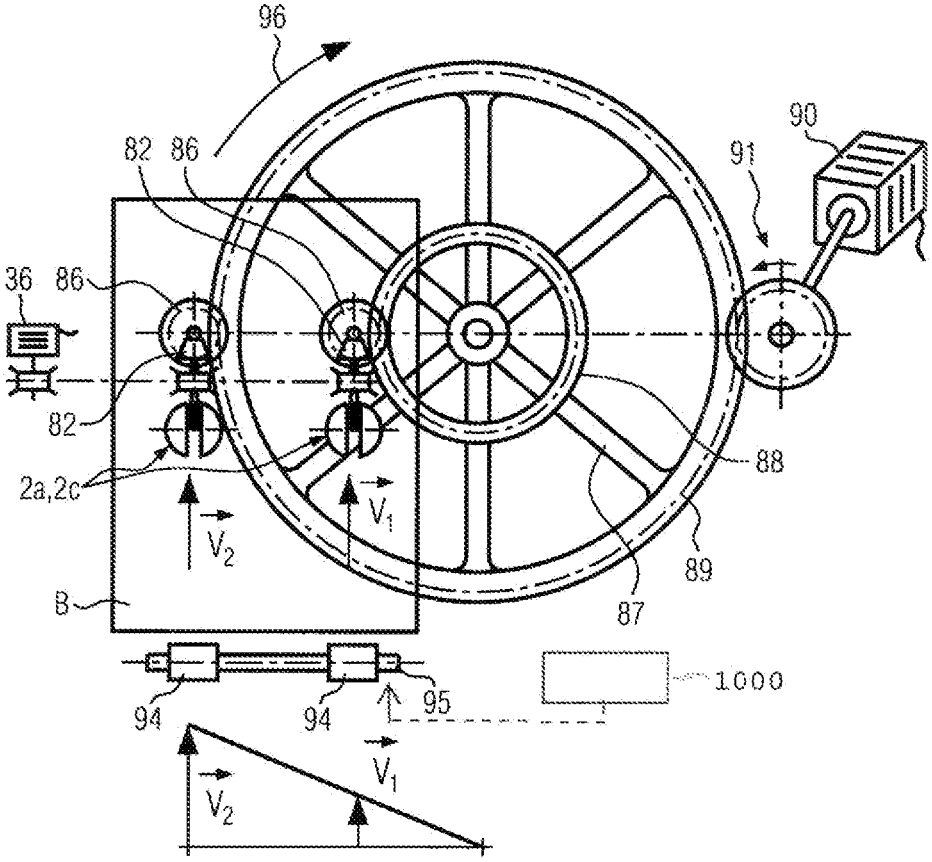
FIG. 9 a schematic plan view of a sheet transporting arrangement, the arrangement comprising a plurality of sheet conveyor devices as shown in FIG. 2.

FIG. 9 shows an arrangement of several sheet conveyor devices 2*a*, 2*c*. The sheet conveyor devices 2*a*, 2*c* essentially correspond to the sheet conveyor device 2*a*, 2*c* of FIG. 5. The sheet conveyor devices 2*a*, 2*c* are attached to a common sheet metal support 29 and supported relative to said support. The sheet conveyor devices 2*a*, 2*c* are arranged on the common sheet metal support 29 in a plane with parallel rotational axes 7 and 8, so that the two sheet transport bodies 5 of the sheet conveyor device 2*a*, 2*c* are located on the same level. The driveshafts 50*b* and the hollow shafts 28 of the two sheet conveyor devices 2*a*, 2*c* are arranged so as to be parallel to each other in perpendicular direction in FIG. 9. A pulley 71 is located on each of the driveshafts 50*b* of the two sheet conveyor devices 2*a*, 2*c*. The pulleys 71 of the two sheet transport devices 2*a*, 2*c* are on the same relative level and are in alignment with the pulley 70 on the shaft of the motor 46*b*. The belt 80 is moved around the pulley 70 as well as around the pulley 71 of the two sheet transport devices 2*a*, 2*c*. Each of the bevel gears 80 on the ends of the driveshafts 50*b* is in engagement with a separate bevel gear 86, the rotational axis of the latter bevel gear extending perpendicularly to the sheet plane in FIG. 9. The bevel gears 86 are in engagement with a driving wheel 87 which has an inside driving wheel component 88 and outside driving wheel component 89. The driving wheel 87 is either directly connected with a driving motor 90, or, as shown in FIG. 9, by means of a transmission 91 arranged between the driving motor 90 and the driving wheel 87. Furthermore, the arrangement of FIG. 9 comprises two transport rollers 94 that are rotatably supported on an axle 95 and are in alignment with the sheet conveyor devices 2*a*, 2*c*.

During operation, a sheet B to be processed is supplied from the underside in FIG. 9 by means of the transport rollers 94. The sheet B moves at the same speed $V_R$ over the two transport rollers 94 and finally reaches the sheet transport body 5 of the two sheet conveyor devices 2*a*, 2*c*. If the two sheet transport bodies 5 are driven by means of the driving motor 46*b*, the sheet transport bodies 5—in particular the two half shells 10, 11—perform a rotation about the rotational axis 8 and continue to evenly transport the sheet B at the transport speed $V_R$ in the direction of the rotational axis 7. However, as soon as the two sheet conveyor devices 2*a*, 2*c* are driven by means of the driving motor 90 and the driving wheel 87, the half shells 10, 11 of the two separate sheet conveyor devices 2*a*, 2*c* perform a rotation at a different speed. The right sheet conveyor device 2*a*, 2*c* is driven more slowly than the left sheet conveyor device 2*a*, 2*c*. The reason being that the inner driving wheel component 88 that drives the bevel gear 82 of the right sheet conveyor device 2*a*, 2*c* provides a slower driving speed due to its smaller diameter than the out driving wheel component 89 that is in engagement with the bevel gear 82 of the left sheet conveyor device 2*a*, 2*c*. When the driving motor 90 is used for driving thus the right or the inner and the left or the outer bevel gear 82 are driven at different speeds. The different speeds have a fixed ratio, namely the ratio of the diameter of the inner and the outer driving wheel components 88, 89. Inasmuch as the sheet B is driven at a faster speed on the left side than on the right side, the sheet B performs a rotation in the direction of the arrow 96. With the use of the arrangement shown in FIG. 9 it is possible to accomplish straight movements of the sheet B or a deflection of the sheet B in the direction of the arrow 96.

The invention has been described with reference to preferred exemplary embodiments, wherein the individual features of the described exemplary embodiments can be freely combined and/or interchanged with each other, provided that they are compatible. Likewise, individual features of the described exemplary embodiments may be omitted, provided that they are not absolutely necessary. Numerous modifications and embodiments are conceivable and obvious to the person skilled in the art without departing from the inventive idea.

The invention claimed is:

1. A sheet turning unit comprising:

a first sheet conveyor device for transporting a sheet at least along a first transport path in a first plane;

a second sheet conveyor device for transporting the sheet along a second transport path, said second transport path extending at an angle of 90° with respect to the first transport path and describing a curve of 180° , wherein a starting point of said curve is located in the first plane and an end point of said curve is located in a second plane that is different from the first plane; and a third sheet conveyor device for transporting the sheet along at least a third transport path;

wherein at least one of the first or third sheet conveyor devices, respectively, comprise at least one sheet transport body that can be rotated, by means of a rotating mechanism arranged in the sheet transport body, about a first and a second rotational axis, said axes extending through one point of intersection and being perpendicular to one another, wherein the sheet transport body can be driven for rotation about at least one of the rotational axes by means of a driving mechanism and a driving motor connected therewith, and wherein the driving mechanism comprises a freewheel arranged between the sheet transport body and the driving motor.

2. Sheet turning unit as in claim 1, wherein the third transport path extends in the same direction as the first transport path; or in the same direction as the second transport path; or in the direction opposite the first transport path.

3. Sheet turning unit as in claim 1, wherein the second sheet conveyor device comprises at least one transport roller that is supported so as to be rotatable about a rotational axis, said rotational axis extending parallel to the first transport path.

4. Sheet turning unit as in claim 3, wherein the second transport path-extends over 180° along an outside circumference of the transport roller.

5. Sheet turning unit as in claim 1, wherein the sheet transport body can be independently rotated about the first and the second rotational axes.

6. A sheet turning unit comprising:

a first sheet conveyor device for transporting a sheet at least along a first transport path in a first plane;

a second sheet conveyor device for transporting the sheet along a second transport path, said second transport path extending at an angle of 90° with respect to the first transport path and describing a curve of 180° , wherein a starting point of said curve is located in the first plane and an end point of said curve is located in a second plane that is different from the first plane; and a third sheet conveyor device for transporting the sheet along at least a third transport path;

wherein at least one of the first or third sheet conveyor devices, respectively, comprise at least one sheet transport body that can be rotated, by means of a rotating mechanism arranged in the sheet transport body, about a first and a second rotational axis, said axes extending through one point of intersection and being perpendicular to one another, and wherein the sheet transport body is spherical and comprises ring-shaped transport paths that extend over the circumference of the spherical sheet transport body.

7. Sheet turning unit as in claim 1, wherein at least one of the first or third sheet conveyor devices, respectively, comprise several sheet transport bodies that are driven by a common driving motor.

8. Sheet turning unit as in claim 1, wherein pressure roller bodies are resiliently supported opposite the sheet transport bodies so that the pressure roller bodies and the sheet transport body can hold a sheet.

9. Sheet turning unit as in claim 1, wherein the first, second and/or third sheet conveyor device comprise at least one transport roller and a transport roller lifting mechanism that is suitable to lift the transport roller off the transport path in a controlled manner.

10. Sheet turning unit as in claim 1, wherein at least one of the first, second or third sheet conveyor devices comprise at least one transport roller having a segmented recess or a flat region on its circumference.

11. Sheet turning device as in claim 1, wherein each of the first and the third sheet conveyor devices comprises at least one sheet transport body, whereby a number of sheet transport bodies of the third sheet conveyor device is greater than a number of the sheet transport bodies of the first sheet conveyor device.

12. Sheet transport arrangement comprising at least two sheet conveyor devices as in claim 1, the sheet transport path of said devices being arranged on the same level.

13. Sheet transport arrangement as in claim 12, wherein the sheet conveyor devices can be driven at different speeds.

14. Sheet transport arrangement-as in claim 13, wherein the different speeds are at a fixed gear ratio relative to each other.

* * * * *